US008893523B2

(12) United States Patent
Talegaonkar et al.

(10) Patent No.: US 8,893,523 B2
(45) Date of Patent: Nov. 25, 2014

(54) METHOD OF OPERATING A REFRIGERATOR

(75) Inventors: Arun Talegaonkar, Louisville, KY (US); Daniel Renz, Louisville, KY (US); Geoffrey Lee Ranard, Louisville, KY (US); Bipin N. Shaha, Andra pradesh (IN); Joseph Thomas Waugh, Louisville, KY (US)

(73) Assignee: General Electric Company, Schenectady, NY (US)

( * ) Notice: Subject to any disclaimer, the term of this patent is extended or adjusted under 35 U.S.C. 154(b) by 900 days.

(21) Appl. No.: 12/951,174

(22) Filed: Nov. 22, 2010

(65) Prior Publication Data

US 2012/0125017 A1 May 24, 2012

(51) Int. Cl.
*F25C 5/02* (2006.01)
*F25C 5/00* (2006.01)
*F25C 5/18* (2006.01)

(52) U.S. Cl.
CPC ..... *F25C 5/005* (2013.01); *F25C 5/182* (2013.01); *F25C 2400/10* (2013.01); *F25C 2700/10* (2013.01)
USPC ..... 62/320

(58) Field of Classification Search
CPC ..... F25C 5/18; F25C 5/182; F25C 5/005; F25C 2400/10; F25C 2700/10; F25C 5/02
USPC ..... 62/56, 135, 137, 320, 340, 344; 241/98, 241/277
See application file for complete search history.

(56) References Cited

U.S. PATENT DOCUMENTS

| | | | | |
|---|---|---|---|---|
| 5,037,004 | A * | 8/1991 | Katz et al. | 222/146.6 |
| 7,229,656 | B2 * | 6/2007 | Paumen et al. | 426/519 |
| 7,237,393 | B2 * | 7/2007 | Chung et al. | 62/137 |
| 7,698,901 | B2 * | 4/2010 | Koons et al. | 62/137 |
| 2009/0241582 | A1 * | 10/2009 | Kim | 62/344 |
| 2010/0218524 | A1 * | 9/2010 | Saito | 62/135 |

* cited by examiner

*Primary Examiner* — Frantz Jules
*Assistant Examiner* — Emmanuel Duke
(74) *Attorney, Agent, or Firm* — Global Patent Operation; Douglas D. Zhang

(57) ABSTRACT

A method for operating a refrigerator having a driving assembly and an ice storage bin. The driving assembly is releasably engageable with the ice storage bin. The driving assembly has a motor fork. The ice storage bin supports an axle, to which a coupler is secured. The method includes engaging the motor fork with the coupler secured, rotating the motor fork in a first direction based on a user's input, and rotating the motor fork in a second direction opposite to the first direction for a predetermined time or by a predetermined angle at the end of the user's input.

7 Claims, 12 Drawing Sheets

METHOD OF OPERATING A REFRIGERATOR

BACKGROUND OF THE INVENTION

The current disclosure relates generally to refrigerators, and more specifically to a method of operating refrigerators to facilitate removal of the ice storage bins from the refrigerators.

A refrigerator usually has an ice storage bin for storing ice. The ice storage bins typically can be removed from the refrigerator if desired, without the removal of a motor which drives auger and/or ice crusher within the ice storage bin. The ice storage bin is typically coupled to the motor in a dual fork coupling arrangement with one fork being affixed to the motor and the other fork being affixed to a generally horizontally disposed shaft of the ice storage bin. This ice storage bin is typically secured to the refrigerator by tabs or latches. To remove the ice storage bin from the refrigeration, a user needs to first release the tab/latch connection by lifting the ice storage bin vertically. Typically, the fork affixed to the motor rotates in either direction based on input from a user, and can stop rotation whenever the input from the user ends. This stop in operation allows the forks to orient themselves in any random point along 360° of rotation. Once the forks have stopped rotating, if a portion of one fork is vertically above a portion of the other fork, removal of the ice storage bin by a user will be very difficult.

In other words, removal of a typical ice storage bin can be difficult if the coupling forks orient themselves in certain positions.

Therefore, a method for removal of an ice storage bin with a dual fork coupling arrangement is desired.

BRIEF DESCRIPTION OF THE INVENTION

As described herein, the exemplary embodiments of the current invention overcome one or more of the above or other disadvantages known in the art.

One exemplary aspect of the present invention relates to a method of operating a refrigerator including a driving assembly and an ice storage bin. The driving assembly has a motor fork. The ice storage bin supports an axle, to which a coupler is secured. The method includes engaging the motor fork with the coupler, rotating the motor fork in a first direction in response to a user's input, and rotating the motor fork in a second direction opposite to the first direction for a predetermined time or angle after an end of the user's input.

These and other aspects and advantages of the current invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
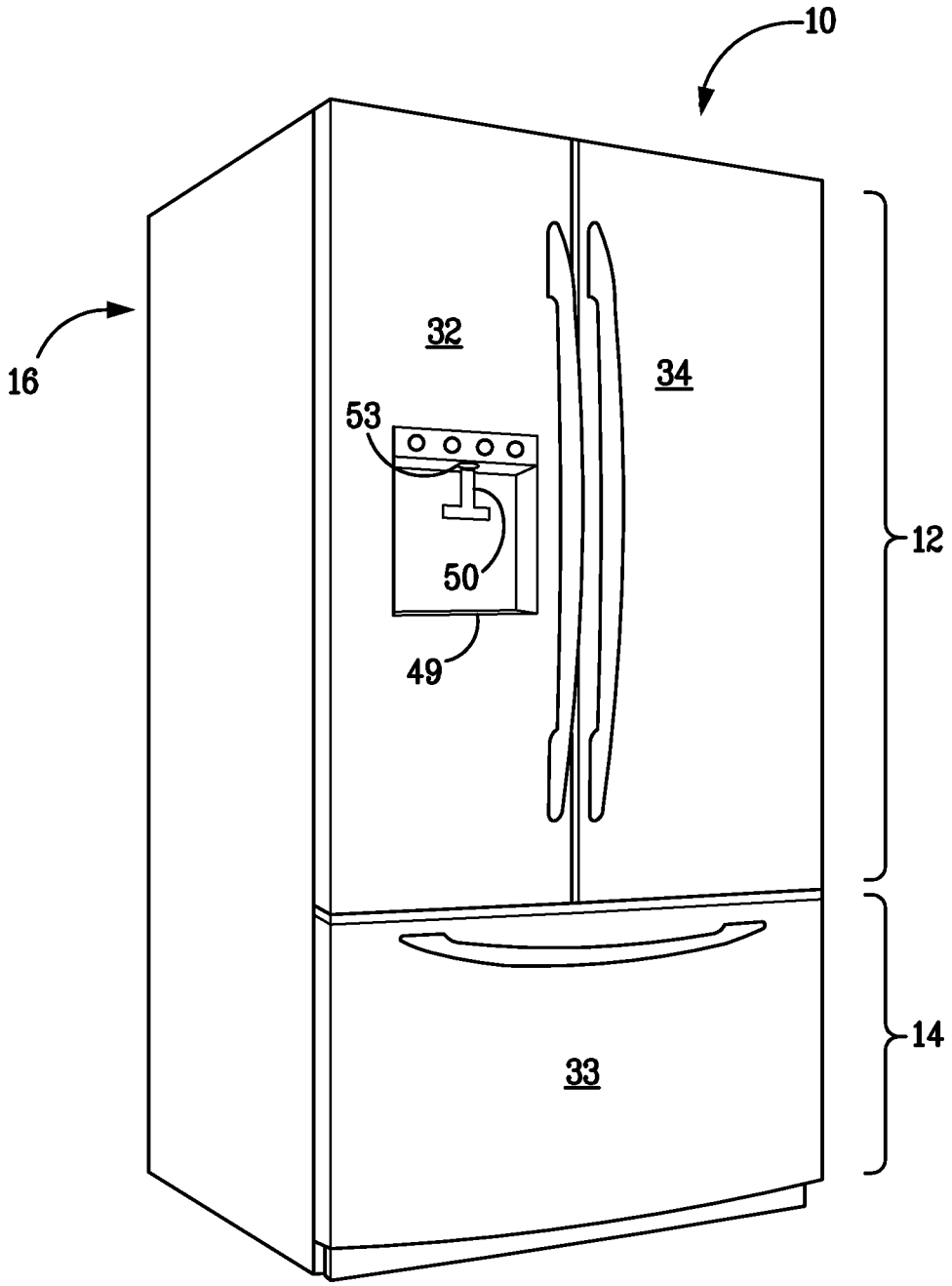
FIG. 1 is a perspective view of a refrigerator in accordance with an exemplary embodiment of the invention.

FIG. 1 illustrates an exemplary refrigerator 10. While the embodiments are described herein in the context of a specific refrigerator 10, it is contemplated that the embodiments may be practiced in other types of refrigerators. Therefore, as the benefits of the herein described embodiments accrue generally to ice dispensing from the refrigerator, the description herein is for exemplary purposes only and is not intended to limit practice of the invention to a particular type of refrigeration appliance or machine, such as refrigerator 10.

On the exterior of the refrigerator 10, there is disposed an external access area 49 to receive ice cubes and/or drinking water. In response to a user's input, such as a stimulus for dispensing water, a water dispenser 50 allows an outflow of drinking water into a user's receptacle. In response to a user's input, such as a stimulus for dispensing ice, an ice dispenser outlet 53 of an ice making, storage and dispensing compartment 30 (shown in FIGS. 2 and 3) allows an outflow of whole ice cubes into a user's receptacle. In response to a user's input, such as another stimulus for dispensing ice, the ice dispenser outlet 53 can allow an outflow of crushed ice cubes or shaved ice into a user's receptacle. There are two access doors, 32 and 34, to the fresh food compartment 12, and one access door 33 to the freezer compartment 14. Refrigerator 10 is contained within an outer case 16.

Figure 2:
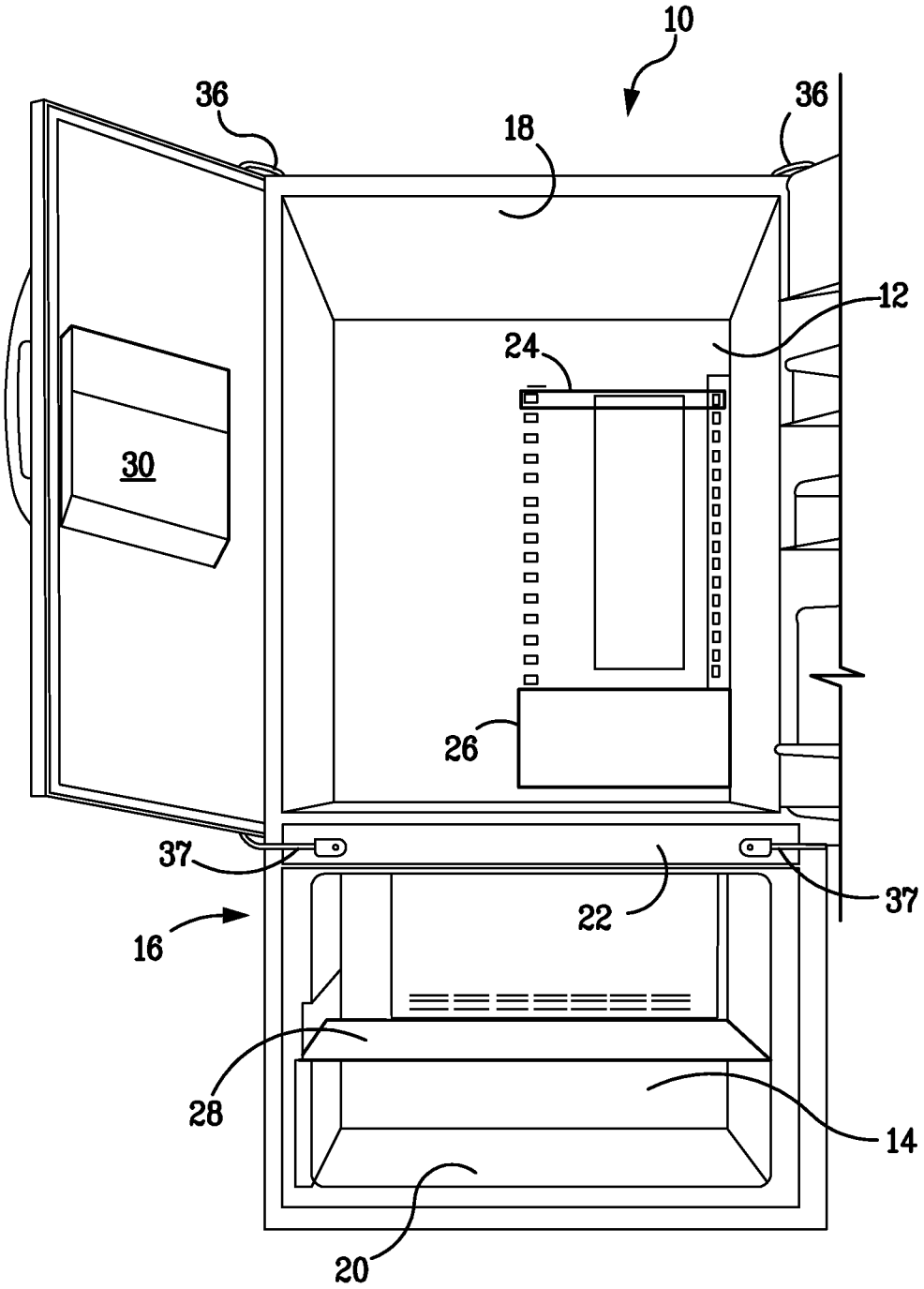
FIG. 2 is a perspective view of the refrigerator of FIG. 1 with the refrigerator doors being in an open position and the freezer door being removed for clarity.

As shown in FIG. 2, refrigerator 10 includes food storage compartments such as a fresh food compartment 12 and a freezer compartment 14. As shown, fresh food compartment 12 and freezer compartment 14 are arranged in a bottom mount refrigerator-freezer configuration. Refrigerator 10 includes outer case 16 and inner liners 18 and 20. A space between outer case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of the case. A bottom wall of outer case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances.

The insulation in the space between liners 18, 20 is covered by another strip of suitable material, which is also commonly referred to as a mullion 22. Mullion 22 in one embodiment is formed of an extruded ABS material.

Shelf 24 and slide-out drawer 26 can be provided in fresh food compartment 12 to support items being stored therein. A combination of shelves, such as shelf 28, is provided in freezer compartment 14.

Left side fresh food compartment door 32, right side fresh food compartment door 34, and a freezer door 33 close access openings to fresh food compartment 12 and freezer compartment 14, respectively. In one embodiment, each of the doors 32, 34 are mounted by a top hinge assembly 36 and a bottom hinge assembly 37 to rotate about its outer vertical edge between a closed position, as shown in FIG. 1, and an open position, as shown in FIG. 2. The ice making, storage and dispensing compartment 30 can be seen on the interior of left side fresh food compartment door 32.

Figure 3:
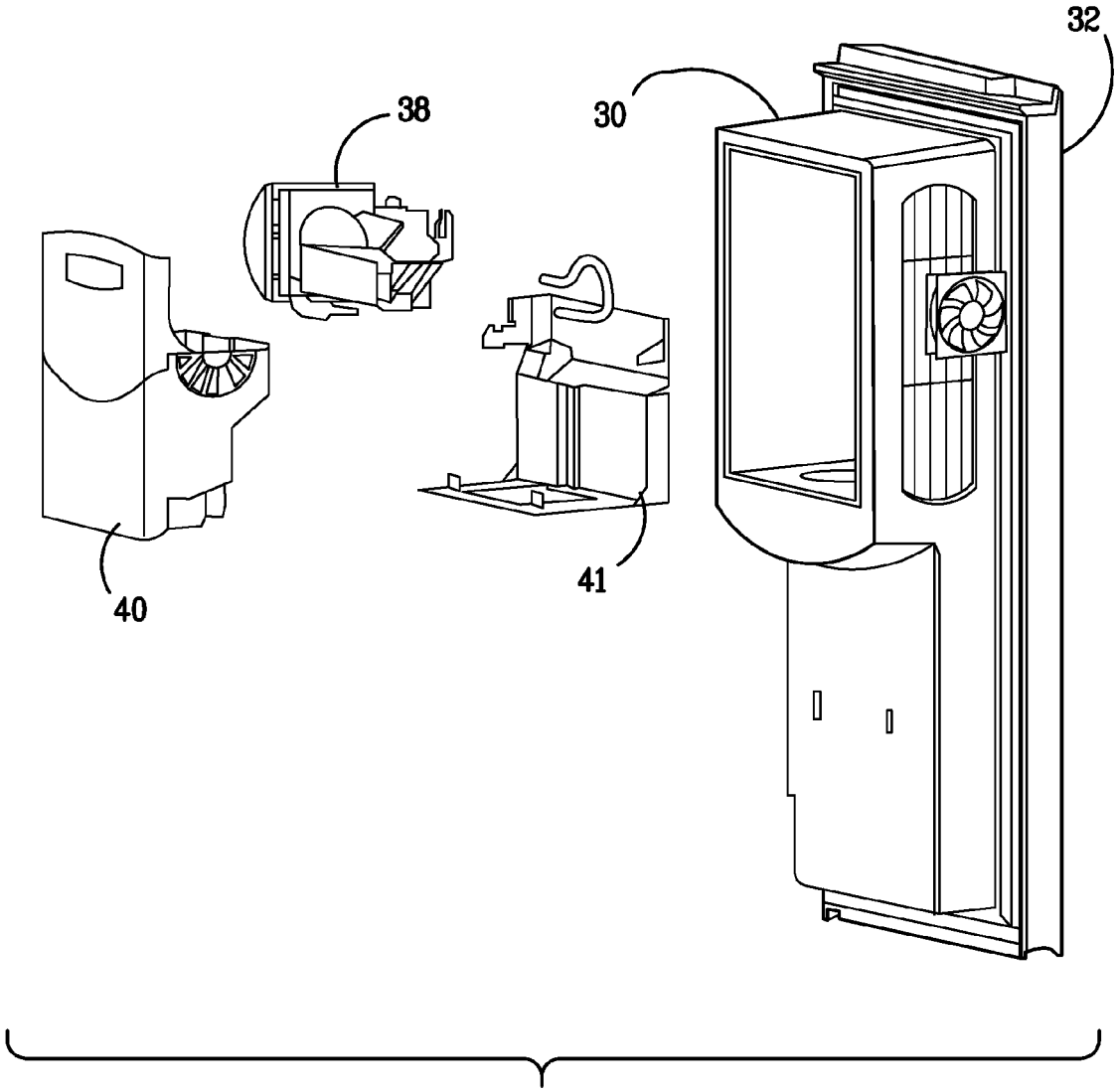
FIG. 3 is a partial exploded view of an exemplary door for the fresh food compartment of the refrigerator, the door including an ice storage bin.

As shown in FIG. 3, the exemplary ice making, storage and dispensing compartment 30 is disposed on the interior of left side fresh food compartment door 32. An apparatus 40 for breaking ice clumps can be mounted into the compartment 30. A driving assembly 41, also disposed within the compartment 30, is drivingly engageable with the apparatus 40. For example, the driving assembly 41 has a motor for rotatably driving the apparatus 40. An electronic ice maker 38 can be disposed above the apparatus 40. The apparatus 40 can be removed and replaced into the ice making, storage and dispensing compartment 30 by a user for cleaning or other purposes.

Figure 4:
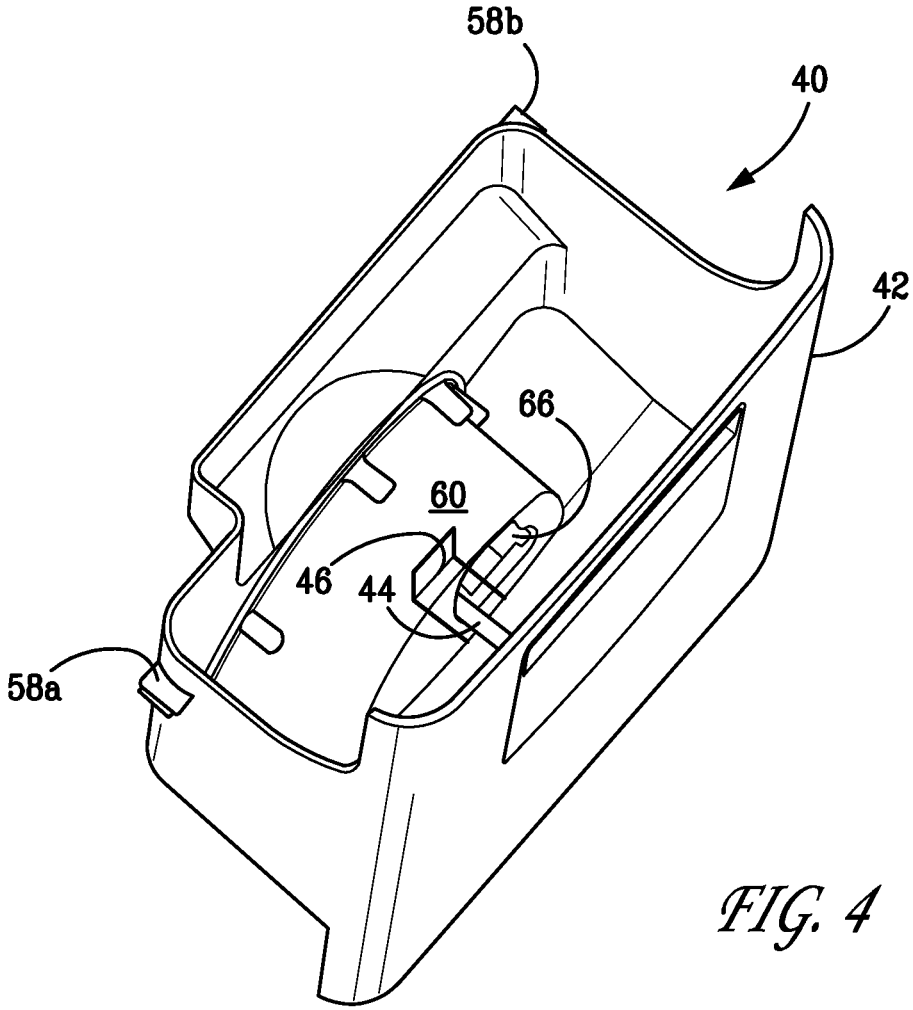
FIG. 4 is a perspective view of the ice storage bin.

As shown in FIG. 4, the exemplary apparatus 40 includes an ice storage bin 42, an axle 44 rotatably supported by the ice storage bin 42, an actuator 45 (shown in FIGS. 6-7C) operatively coupled to the axle 44 to rotate upon the driving of the axle 44, and an ice breaker 46 operatively coupled to the actuator 45 and disposed within the ice storage bin 42. The ice breaker 46 is configured to move in a reciprocal manner upon rotation of the actuator 45, to break ice clumps formed by the ice cubes in the ice storage bin 42.

The apparatus 40 further includes a housing 60 disposed within the ice storage bin 42. The housing 60 includes a front wall 56, a first opening 66 in the front wall 56, and a second opening (not shown) downstream of the first opening 66 such that ice can move from the first opening 66 to the second opening under gravity or action. Ice cubes of suitable sizes can pass through the first opening 66 ad move into an ice crushing area within the housing 60, where the ice cubes can be crushed or shaved by a set of blades driven by the axle 44, under a user's input. The second opening is in communication with the outlet 53 of the compartment 30 to allow the crushed or shaved ice be dispensed through the outlet 53.

Figure 5:
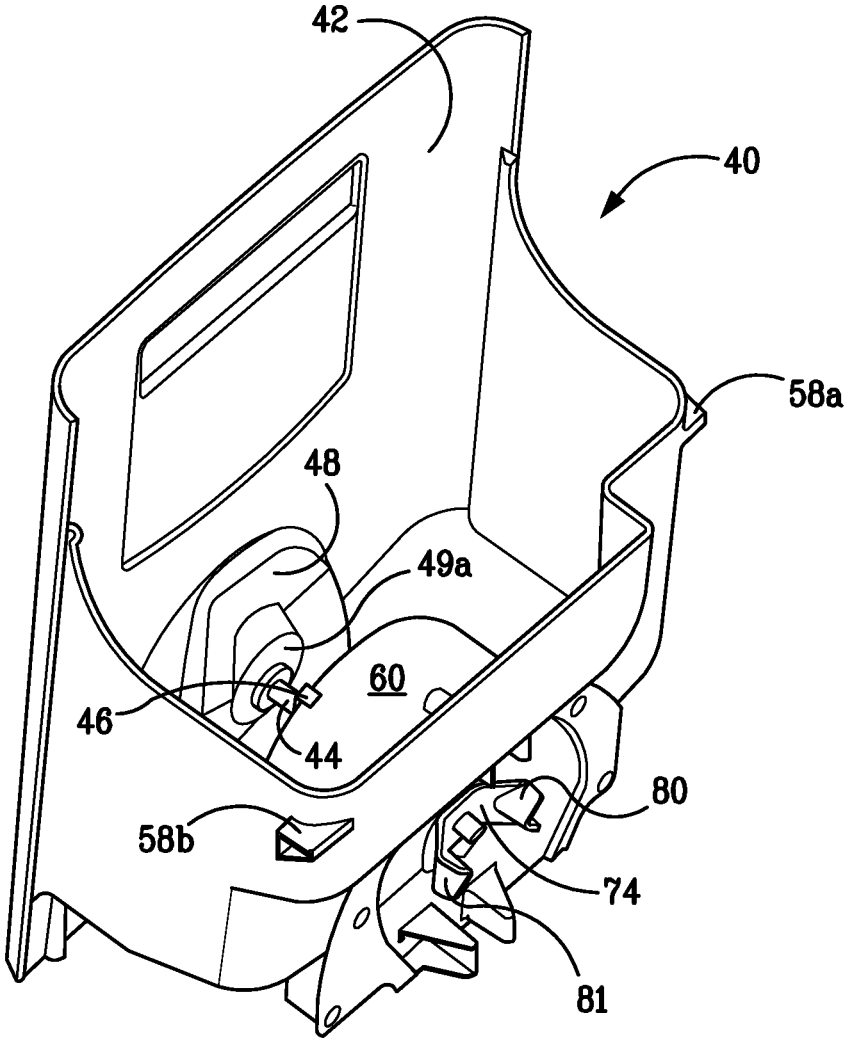
FIG. 5 is another perspective view of the ice storage bin.

As illustrated in FIG. 5, the apparatus 40 can further include an agitator 48 disposed within the storage bin 42 substantially opposite to the first opening 66 of the housing 60. The agitator 48 is operatively coupled to the axle 44 and configured to rotate upon driving of the axle 44. For example, the agitator 48 can include at least one extension 49*a* with curved profile, for propelling ice cubes present in the ice storage bin 42 into the housing 60 through the first opening 66.

Ice cubes stored in the storage bin 42 may clump together if exposed repeatedly to warming and freezing cycles. In this case, the ice clumps formed from the ice cubes may stick to the ice storage bin 42 and/or become too big to enter the first opening 66. Thus, no ice can be delivered under a user's input. The ice breaker 46, according to the exemplary embodiment of the present invention, serves to break the ice clumps into ice pieces sufficiently small to pass through the first opening 66.

As shown in FIG. 5, the apparatus 40 further includes structures for mechanically engaging the driving assembly 41. For example, the apparatus 40 includes a pair of mating tabs 58*a* and 58*b* and a coupler 74, disposed externally of the ice storage bin 42. The mating tabs 58*a* and 58*b* are configured to releasably engage complementary mating structures of the driving assembly 41, which will be described later. The coupler 74 is secured to the axle 44 and configured to transfer the rotation of a motor of the driving assembly 41 to the axle 44 of the apparatus 40. For example, the coupler 74 can have two extensions 80 and 81 extending away from the surface of the coupler 74, which are configured to engage complementary structures of the motor so as to transfer the rotation of the motor to the axle 44.

Figure 6:
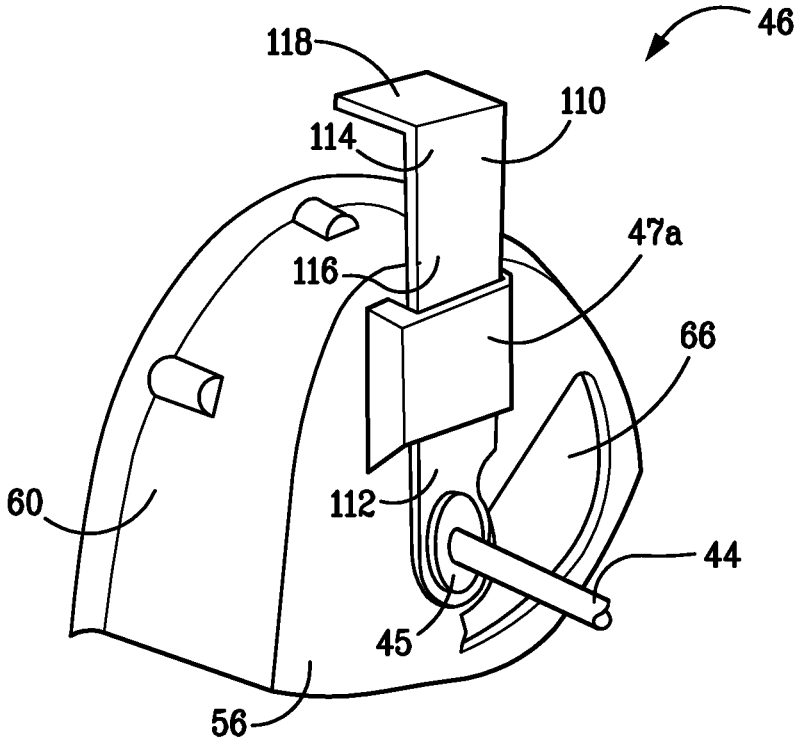
FIG. 6 is a partial perspective view of an ice clumps breaking apparatus of the ice storage bin.

FIG. 6 is a partial perspective view showing the apparatus 40 having the ice breaker 46 for breaking ice clumps. The ice breaker 46 is operatively coupled to the actuator 45. In the shown embodiment, the actuator 45 includes an eccentric cam affixed to the axle 44, so that as the axle 44 rotates in either direction, the off-center placement of the eccentric cam causes the ice breaker 46 to move reciprocally. As the axle 44 rotates, the ice breaker 46, with its reciprocal movement, exerts a force on clumps of ice which are present in the ice storage bin 42.

In this exemplary embodiment, the ice breaker 46 is disposed adjacent to the front wall 56 of the housing 60, and includes an elongated body 110 having a first end 112 and a second end 114 connected by a middle portion 116. The first end 112 is operatively connected to the actuator 45, and the second end 114 is disposed to extend beyond the housing 60. Optionally, the ice breaker 46 may further include a tip 118 extending angularly from the second end 114 and preferably above the housing 60. For example, the tip 118 of ice breaker 46 is shown as taking a 90° angle from the elongated body 110 of the ice breaker 46, but the tip 118 could be arranged in any suitable direction. The tip 118 is provided to enhance the ice breaking ability of the ice breaker 46. However, a person of ordinary skill in the art understands that any part of the ice breaker 46 can break clumps of ice present in the ice storage bin 42.

Figure 7A:
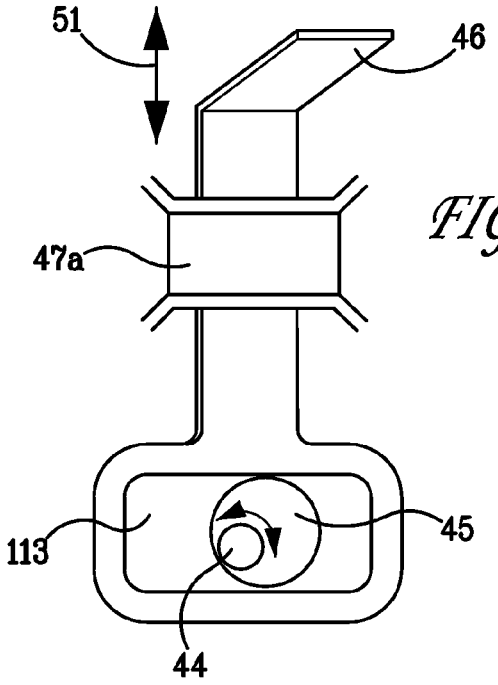
FIGS. 7A-7C are partial perspective views of an exemplary guide member of the apparatus.
Figure 7B:
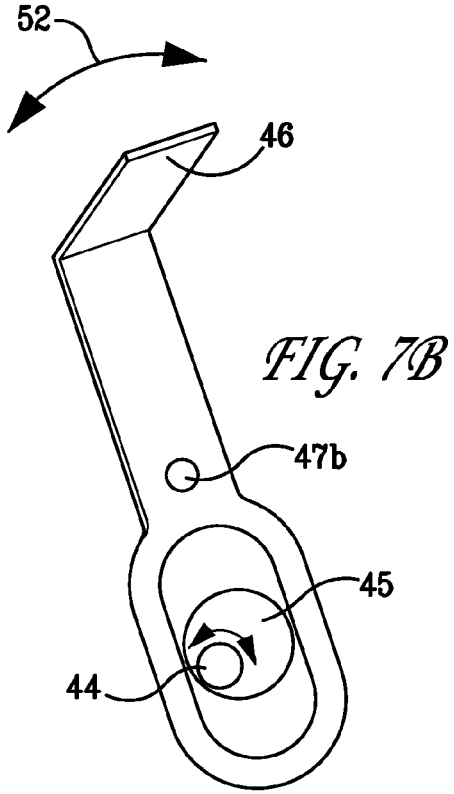
Figure 7C:
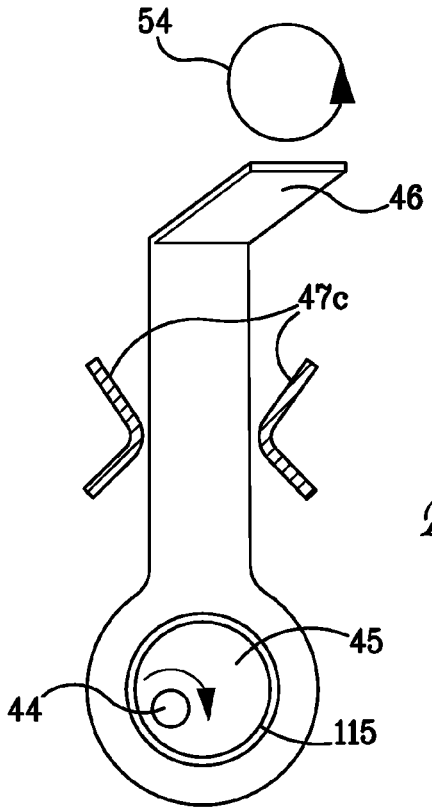

The apparatus 40 further includes an ice breaker guide 47*a* for guiding the ice breaker 46's movement. For example, the ice breaker guide 47*a*, in cooperation with the actuator 45 such as the eccentric cam, guides ice breaker 46 to move reciprocally in a desirable manner. FIGS. 7A-7C illustrates three exemplary embodiments of how the ice breaker 46 is guided and operated.

As shown in FIG. 7A, the ice breaker 46 includes a cavity 113, for example, a substantially rectangular cavity, disposed in the first end 112 of the elongated body 110. The eccentric cam 45 is operatively accommodated in the cavity 113. The ice breaker guide 47*a* is in the form of a band straddling over the middle portion 116 of the elongated body 110, so that the ice breaker 46 can translates upwardly and downwardly in a reciprocal manner under the guidance of the guide 47*a*, as represented by exemplary directional arrow 51. However, a person of ordinary skill in the art understands that the ice breaker guide 47*a* can also include other configurations for guiding the reciprocal translation of the ice breaker 46 along other directions.

FIG. 7B shows another exemplary embodiment of the ice breaker guide, identified by numeral reference 47*b*. The guide 47*b* is in the form of a pin fixed to the front wall 56 of the housing 60. The pin 47*b* extends through the middle portion 116 of the elongated body 117, to allow the second end 114 to pivot reciprocally upon rotation of the eccentric cam 45, along the direction represented by exemplary directional arrow 52.

FIG. 7C shows another exemplary embodiment of the ice breaker guide, identified by numeral reference 47*c*. The guide 47*c* is in the form of a pair of brackets secured to the front wall 56 of the housing 60. The brackets 47*c* are disposed at either side of the middle portion 116 of the elongated body 110, respectively. In this embodiment, the ice breaker 46 includes a cavity 115, provided in the first end 112 of the elongated body 110, which has an inner profile substantially complementary to the outer profile of the eccentric cam 45. When the eccentric cam 45 rotates under the driving of the axle 44, the pair of brackets 47*c* cooperatively engage the middle portion 116 of the ice breaker 46, to allow the second end 114 of the ice breaker 46 to move in a substantially circular fashion, as represented by exemplary directional arrow 54.

If large clumps of ice are formed within the ice storage bin 42, clumps which may be too large to fit through the first housing opening 66 or too large to be dispensed to a user, typically stop all flow of ice. Referring again to FIG. 4, when a user inputs a stimulus requesting ice, the axle 44 rotates and facilitates the movement of whole ice cubes within the ice storage bin 42, through the first housing opening 66 and into a user's receptacle. At the same time, the ice breaker 46 also is moved as the axle 44 rotates as described in the examples above and shown in FIGS. 7A-7C. As the ice breaker 46 is moved, it contacts clumps of ice and breaks up the clumps of ice to a sufficiently small size, so that the broken clumps of ice can pass through the first housing opening 66 and can be dispensed to a user.

Figure 8A:
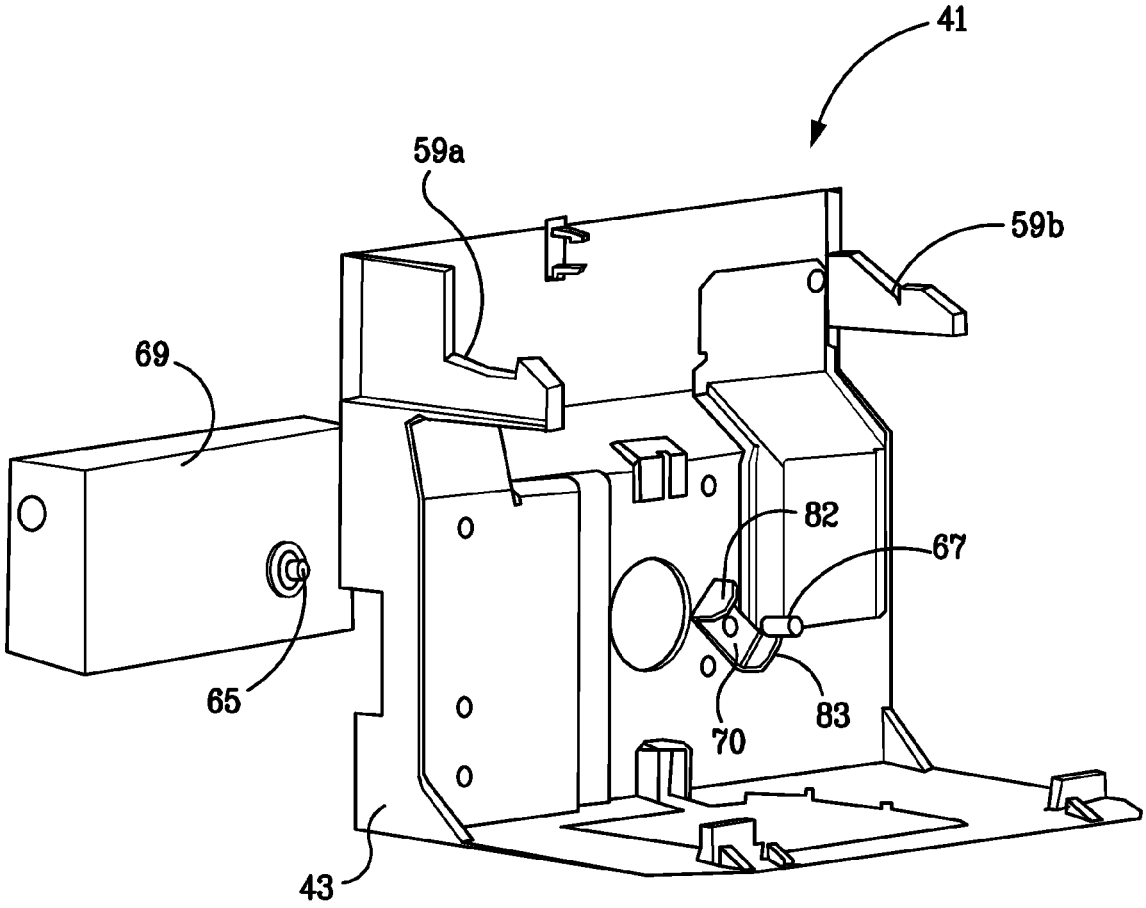
FIG. 8A is an exploded view of a driving assembly of the refrigerator.
Figure 8B:
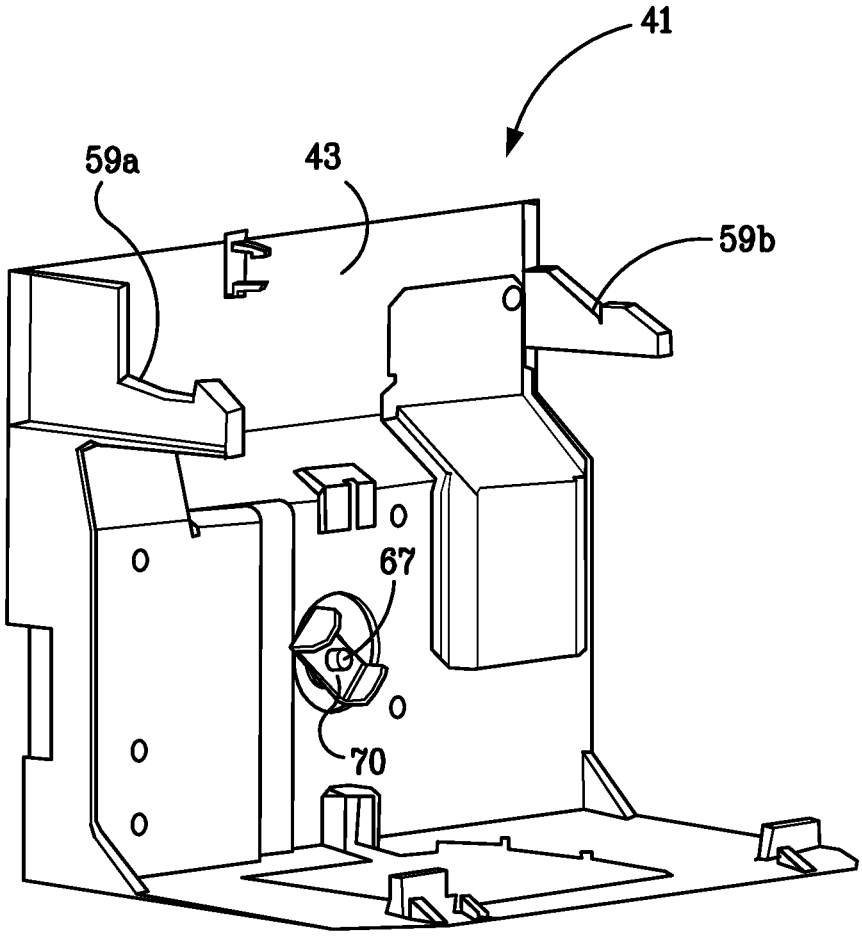
FIG. 8B is a perspective view of part of the driving assembly.

The driving assembly 41 drives the ice breaker 46 as well as the set of blades in the ice crushing area of the housing 60. As shown in FIG. 8A, the driving assembly 41 includes a base member 43 and a motor 69 which can be mounted to the base member 43. The motor 69 includes a motor axle 65 extending from the motor 69 and through an opening of the base member 43. The driving assembly 41 further includes a motor fork 70, which is disposes on the opposite side of the base member 43, with respect to the motor 69. The motor fork 70 is fixedly secured to the motor axle 65 through a securer 67. In this embodiment, the motor securer 67 is shown as a threaded nut but could be any means for securing motor fork 70 to motor axle 65. The motor fork 70 is configured to engage the coupler 74 of the apparatus 40, thereby transferring the drive torque of the motor axle 65 to the axle 44 of the apparatus 40. The motor fork 70 can include a pair of extensions 82 and 83, which engage the pair of extensions 80 and 81 (shown in FIG. 5) of the coupler 74, respectively. The driving assembly 41 further includes a pair of mating latches 59*a* and 59*b*, which are configured to releasably engage the mating tabs 58*a* and 58*b* (shown in FIG. 5) of the apparatus 40.

During operation, the driving assembly 41 is first installed in the compartment 30, for example, on the interior of left side fresh food compartment door 32. Subsequently, the apparatus 40 is mechanically attached to the driving assembly 41 through the engagement between the mating tabs 58*a* and 58*b* of the apparatus 40 and the mating latches 59*a* and 59*b* of the driving assembly 41. At the same time, the apparatus 40 is drivenly connected to the driving assembly 41 through the engagement between the extensions 80 and 81 of the coupler 74 and the extensions 82 and 83 of the motor fork 70. Once the apparatus 40 and the driving assembly 41 are mechanically and operatively connected to each other, sealing material can be applied to place them in the compartment 30 in a sealed manner.

Figure 9:
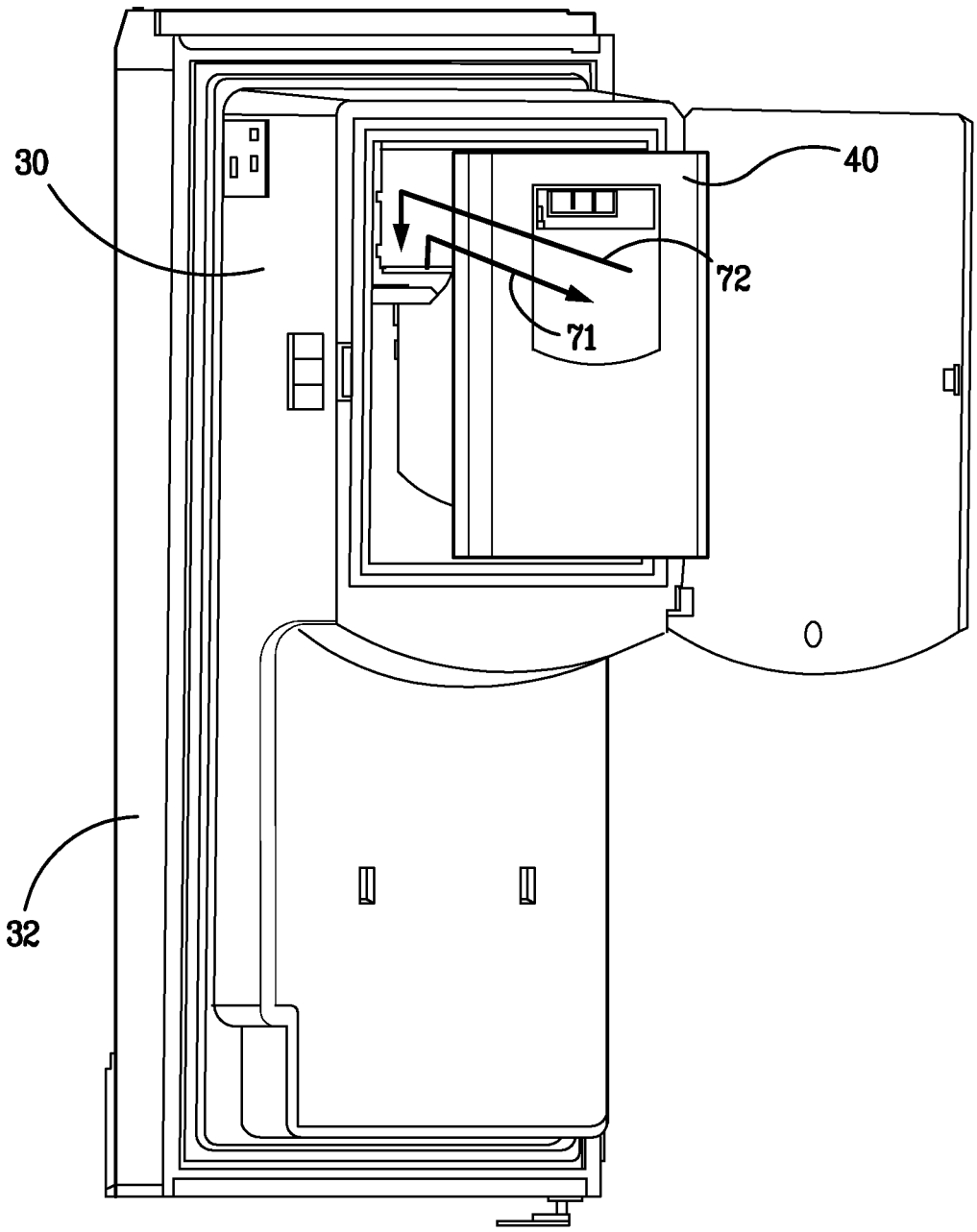
FIG. 9 is a partial perspective view of the refrigerator, showing assembly and removal of the ice storage bin with respect to the door.

FIG. 9 shows the process for attaching the ice clumps breaking apparatus 40 to the driving assembly 41 and removing the apparatus 40 from the driving assembly 41. As shown, for a user to attach the apparatus 40, the user slides the ice storage bin 42 into the compartment 30 and vertically down so that the tabs 58*a* and 58*b* catch the latches 59*a* and 59*b* respectively. The movement to attach the apparatus 40 is represented by an ice storage bin insertion arrow 72. For a user to remove the apparatus 40, the user lifts the ice storage bin 42 vertically upwards, and subsequently slides the ice storage bin 42 out of the compartment 30 so that the tabs 58*a* and 58*b* move above the edge of the tab latches 59*a* and 59*b*. The movement to remove the apparatus 40 is represented by an ice storage bin removal arrow 71.

Figure 10A:
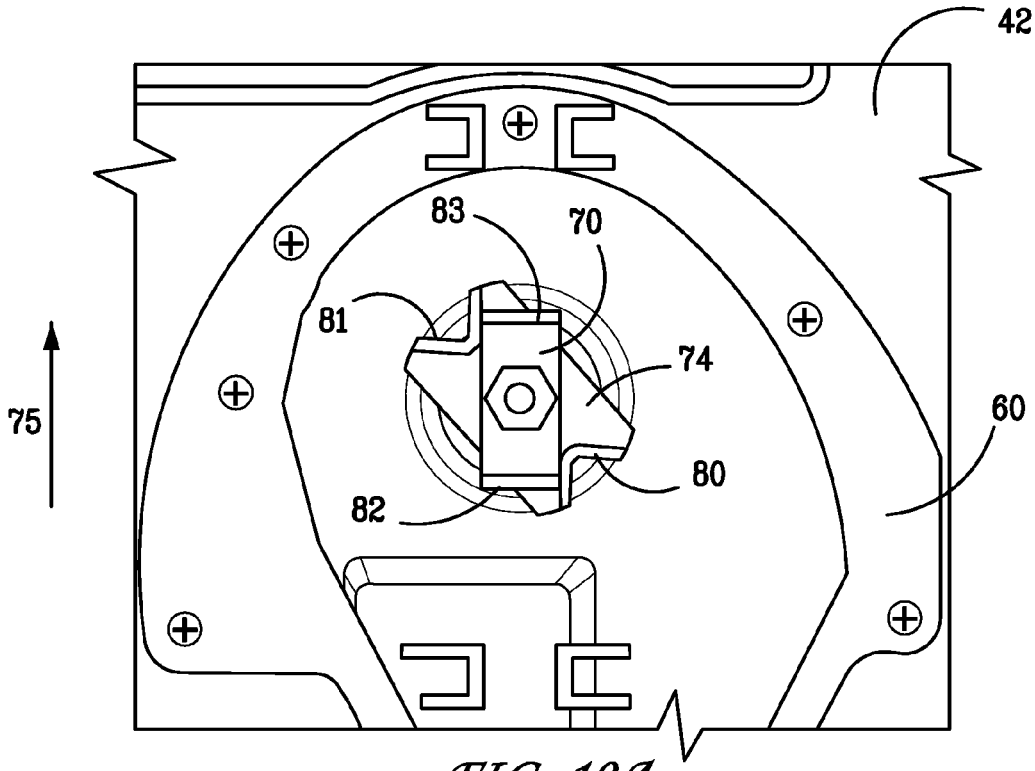
FIGS. 10A and 10B are schematic views, showing the interaction between a coupler of the ice storage bin and a motor fork of the driving assembly in both directions of rotation.
Figure 10B:
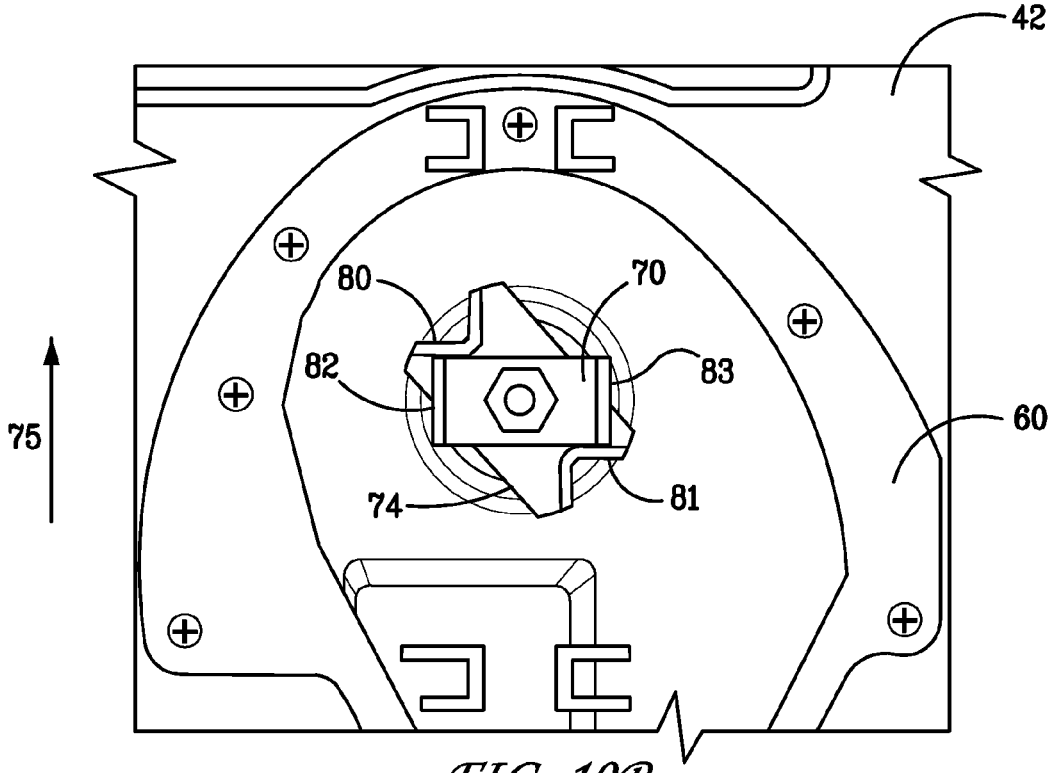

Attachment and removal of the apparatus 40 with respect to the driving assembly 41 can occur, as long as the coupler 74 of the apparatus 40 and the motor fork 70 of the driving assembly 41 are properly aligned to each other. FIGS. 10A and 10B are views of the interaction between the coupler 74 of the apparatus 40 and motor fork 70 of the driving assembly 41 as viewed from the motor 69, looking at the exterior of the ice storage bin 42. FIGS. 10A and 10B show the interaction of ice storage bin coupler 74 and motor fork 70, such that they contact each other upon rotation.

The motor fork extensions 82 and 83 of the motor fork 70 interact with the extensions 80 and 81 of the coupler 74 respectively, so that when the motor 69 rotates, motor fork extensions 82 and 83 contact and cause the coupler extensions 80 and 81 to rotate accordingly.

In the orientation shown in FIG. 10A, if a user were to remove ice storage bin 42, the coupler 74 could vertically pass the motor fork 70, as shown by an exemplary removal direction arrow 75, without either of the sections of the coupler 74 and motor fork 70 getting stuck and/or obstructing each other. In the orientation shown in FIG. 10B, if a user were to attempt to remove the ice storage bin 42, in the direction of the exemplary removal direction arrow 75, the motor fork extension 82 would interfere the coupler extension 80, preventing the removal of ice storage bin 42.

During operation, the coupler 74 and the motor fork 70 may end their rotation at any orientation in reference to each other, depending on the random time a user causes the motor 69 to stop rotating. The orientations shown in FIGS. 10A and 10B are two examples of the orientation of the coupler 74 and the motor fork 70 after they stop rotating. The motor 69 can cause the coupler 74 and the motor fork 70 to rotate in either a clockwise or counter-clockwise direction based on an input by a user.

According to another exemplary aspect of the present invention, a method of operating a refrigerator is provided. The exemplary method ensures that the removal of the ice storage bin 40 can occur by ensuring that the extensions 80 and 81 of the ice storage bin coupler 74 and the extensions 82 and 83 of the motor fork 70 do not stop rotation at an orientation where the extensions would interfere with each other, such as the one shown in FIG. 10B.

The exemplary method includes engaging the motor fork 70 of the driving assembly 41 of the refrigerator with the coupler 74 of the ice clumps breaking apparatus 40 of the refrigerator; rotating the motor fork 70 in a first direction based on a user's input; and rotating the motor fork 70 in a second direction, opposite to the first direction, for a predetermined time or by a predetermined angle after at the end of the user's input.

Figure 11:
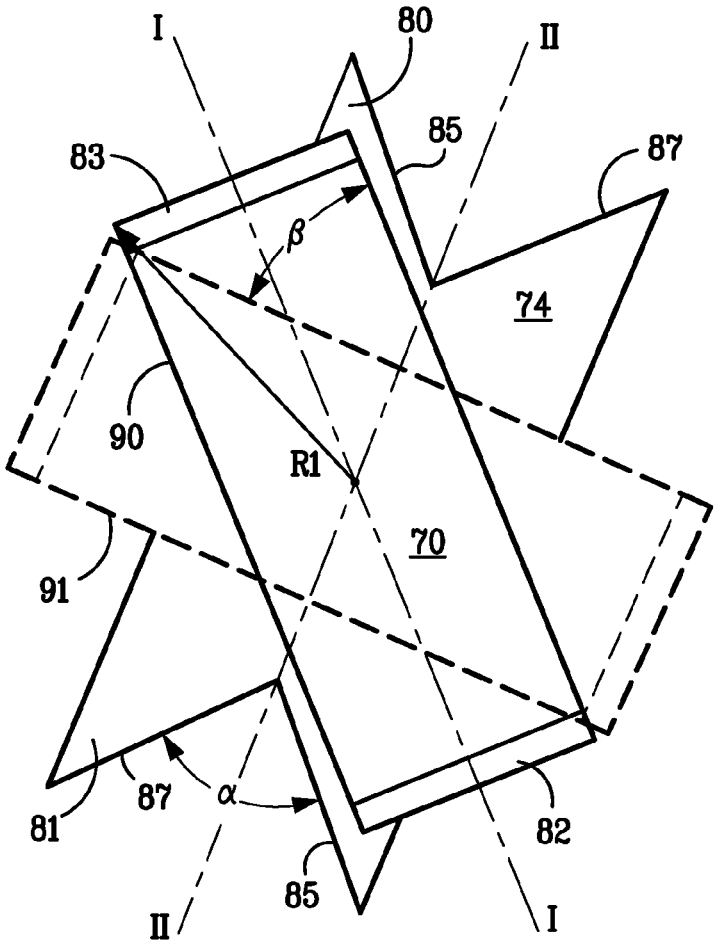
FIG. 11 is a graphical representation of the coupler and the motor fork.

FIG. 11 is a graphical representation of the coupler 74, the coupler extensions 80 and 81, the motor fork 70, and the motor fork extensions 82 and 83. In this graphical representation, the coupler extensions 80 and 81 would be extending out of the page towards the motor fork 70 while the motor fork extensions 82 and 83 would be extending into the page, towards the coupler 74. The motor fork 70 rotates in either direction, based on input by a user. For example, if a user wants whole ice cubes, the motor fork 70 rotates in a first, clockwise direction, and if a user wants shaved or crushed ice cubes, the motor fork 70 rotates in a second, counter-clockwise direction.

In order to ensure that the extensions of the coupler 74 and the motor fork 70 do not stop rotation vertically above each other and removal of the ice storage bin 42 can be achieved, the motor 69 rotates in a direction opposite to the direction it was rotating to dispense ice for a predetermined time or by a predetermined angle.

For example, if the motor fork 70 stops rotation in position 90, as shown by the solid lines in FIG. 11, and the motor fork 70 has been rotating in a clockwise direction, the motor 69 will rotate the motor fork 70 in a second, counter-clockwise direction for a predetermined time or by a predetermined angle so that the motor fork will rest in position 91, as shown by the dashed lines in FIG. 11. In another example, if the motor fork 70 is being rotated in a counter-clockwise direction to dispense ice, the motor 69 will rotate the motor fork 70 in the clockwise direction for a predetermined time or by a predetermined angle after the user ends his or her input to dispense ice.

The predetermined time or angle is sufficient to provide a clearance between the coupler extensions 80 and 81 and the motor fork extensions 82 and 83, so as to allow the ice storage bin 42 to be lifted along the removal direction arrow 75 shown in FIG. 10A. The predetermined time or angle would be set to allow the motor fork 70 to rotate counter wise so that it would not contact the coupler extensions 80, 81. As shown in FIG. 11, the motor fork 70 extends substantially along a first axis I-I and the coupler 74 extends substantially alone a second axis II-II. For example, the predetermined time or angle can be set to allow the motor fork 70 to rotate counter wise so that the first axis I-I of the motor fork 70 and the second axis II-II of the coupler 74 would form an angle in the range between 45° and 135°. Preferably, the motor fork 70 rotates counter wise to allow the first axis I-I and the second axis II-II to be substantially perpendicular to each other. In this way, at the end of the rotation, the motor fork 70 would be halfway to contacting the opposite coupler extensions 80, 81. In the example shown in FIG. 11, at the end of rotation to dispense ice, the motor fork extension 83 is contacting the coupler extension 80. The motor fork 70 would then rotate in the counter-clockwise direction to position 91, which would be roughly halfway to the position where the motor fork extension 83 contacts the coupler extension 81. This method ensures that whichever orientation the motor fork 70 and the coupler 74 obtain after rotation to dispense ice, the extensions of the motor fork 70 and the coupler 74 will not block the removal of the ice storage bin 42.

In the exemplary embodiment shown in FIG. 11, the rotational radius R1 of the motor fork 70 is 0.75", and the angle $\alpha$ between the a first prong 85 and a second prong 87 of the extension 80 or 81 of the coupler 74 is about 88°. Furthermore, the motor fork 70 and the coupler 74 are dimensioned so that, when the motor fork 70 rotates halfway between the extensions 80 and 81 of the coupler 74 to allow the first axis I-I to be substantially perpendicular to the second axis II-II, a clearance of 0.25" is provided between the motor fork 70 and the coupler 74, which is sufficient to lift the ice storage bin 42 along the removal direction arrow 75 shown in FIG. 10A to remove the ice storage bin 42. Accordingly, in this exemplary embodiment, a predetermined angle $\beta$ for rotating the motor fork 70 counter clockwise can be determined by the following equation: $\beta=(90°-\alpha/2)$. Thus, the predetermined angle $\beta$ is about 46°, so that the first axis I-I and the second axis II-II would be substantially perpendicular to each other to place the motor fork 70 halfway to contacting the opposite coupler extensions 80, 81. Since the motor 69 rotates 25 RPM at no load, a predetermined time for rotating the motor fork 70 can be about 0.31 seconds. In another embodiment, the predetermined angle $\beta$ is in the range from 16° to 76°.

However, a person of ordinary skill in the art understands that the predetermined time or angle for rotating the motor fork changes as the angle $\alpha$ and/or the rotating speed of the motor change. In addition, the necessary clearance for lifting the ice storage bin 42 changes as the dimensions of the motor fork and the coupler change. Accordingly, without departing from the spirit of the above aspect of the present invention, the person is able to make necessary adjustments to the predetermined time or angle considering the above factors, to ensure that the coupler and the motor fork do not interfere with each other.

Figure 12:
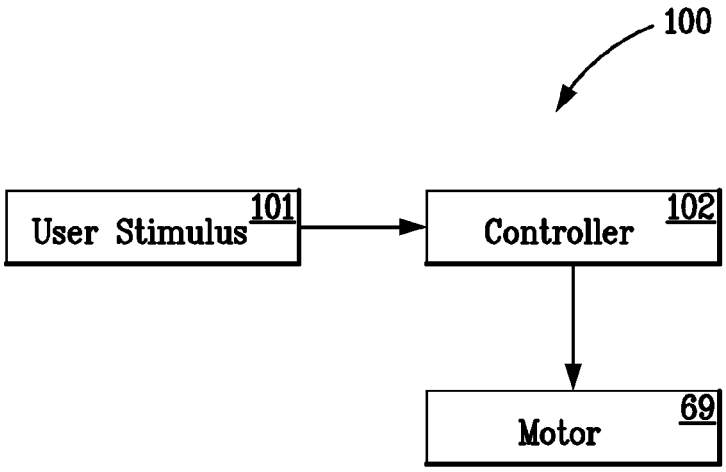
FIG. 12 is a block diagram of an exemplary ice dispenser control system.

FIG. 12 is a block diagram of an exemplary ice dispenser control system 100. The ice dispenser control system 100 includes the motor 69, a controller 102 and a user stimulus 101. The method of controlling the motor 69 based on the user stimulus 101 is inputted into the controller 102, for example, by programming into memory of an application specific integrated circuit (ASIC) or other programmable memory device. Both predetermined time and angle, which the motor 69 rotates in the direction opposite to the direction it was rotating to dispense ice, can be programmed into the controller 102.

The controller 102 controls the operation of the motor 69 based on the user stimulus 101. If a user stimulus 101 occurs, causing the motor 69 to rotate either clockwise or counter-clockwise, the controller 102 will then cause the motor 69 to rotate in the opposite direction for a predetermined time or angle after the user stimulus 101 ends. This predetermined time or angle can be programmed into the memory of the controller 102.

An ice dispenser assembly is provided which provides for the dispensing of ice and the removal of an ice storage bin in an efficient and reliable manner. Ice dispensing efficiency is increased through the breaking of ice clumps by the ice breaker. Ice storage bin removal is also enhanced and provides a method which ensures that removal can occur easily and the ice storage bin coupler and motor fork will not hinder removal of the ice storage bin.

The fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of operating a refrigerator comprising a driving assembly and an ice storage bin releasably engageable with each other, the driving assembly having a motor fork, the ice storage bin supporting an axle to which a coupler is secured, the method comprising:

engaging the motor fork with the coupler;

rotating the motor fork in a first direction based on a user's input; and rotating the motor fork automatically in a second direction, opposite to the first direction, for a predetermined time or by a predetermined angle at the end of the user's input before another user's input, so that the motor fork and the coupler will not block removal of the ice storage bin from the driving assembly.

2. The method according to claim 1, wherein: the motor fork extends substantially along a first axis and the coupler extends substantially along a second axis; and the step of rotating the motor fork in the second direction comprises rotating the motor fork in the second direction for the predetermined time or by the predetermined angle to allow the first axis and the second axis to be substantially perpendicular to each other.

3. The method according to claim 2, wherein: the coupler comprises a pair of extensions configured to engage the motor fork, each extension having a first prong and a second prong connected to each other at an angle $\alpha$; and the predetermined angle is substantially equal to $(90°-\alpha/2)$.

4. The method according to claim 3, wherein the angle $\alpha$ is about 88° and the predetermined angle is about 46°.

5. The method according to claim 4, wherein the predetermined time is about 0.31 seconds when the motor fork rotates 25 rounds per minute.

6. The method according to claim 1, further comprising disengaging the ice storage bin from the driving assembly by translating the motor fork with respect to the coupler.

7. The method according to claim 2, wherein the predetermined angle is in the range from 16° to 76°.

* * * * *